US005457921A

United States Patent [19]

Kostrzecha

[11] Patent Number: 5,457,921

[45] Date of Patent: Oct. 17, 1995

[54] STORM SHUTTER ASSEMBLY

[75] Inventor: Gregory E. Kostrzecha, Coral Springs, Fla.

[73] Assignee: Clearshield, Inc., Riviera Beach, Fla.

[21] Appl. No.: 216,064

[22] Filed: Mar. 22, 1994

[51] Int. Cl.[6] ..... E06B 3/30

[52] U.S. Cl. ..... 52/202; 52/506.05; 52/798.1; 52/783.11

[58] Field of Search ..... 52/202, 309.1, 52/814, 506.05, 795, 797, 798; 49/61, 364

[56] References Cited

U.S. PATENT DOCUMENTS

| | | | |
|---|---|---|---|
| 1,195,505 | 8/1916 | Saino | 52/795 X |
| 1,204,074 | 11/1916 | Saino | 52/795 X |
| 1,240,634 | 9/1917 | Williams | 52/814 |
| 2,878,536 | 3/1959 | Becker | 52/202 |
| 3,358,408 | 12/1967 | Cooper et al. | 52/202 |
| 4,333,271 | 6/1982 | DePaolo et al. | 52/202 X |
| 4,685,261 | 8/1987 | Seaquist | 52/202 |
| 5,345,716 | 9/1994 | Caplan | 49/61 |

*Primary Examiner*—Michael Safavi
*Assistant Examiner*—Robert J. Canfield
*Attorney, Agent, or Firm*—McHale & Slavin

[57] ABSTRACT

A storm shutter assembly used to protect glass windows and doors in homes, office buildings, and other walled structures from the destructive force of storm systems, such as hurricanes. The present storm shutter assembly includes a corrugated panel made up of at least one sheet of a shatter-resistant and transparent plastic material having a plurality of corrugations. Each corrugated sheet of the plastic material is firmly secured to the walled structure.

14 Claims, 3 Drawing Sheets

STORM SHUTTER ASSEMBLY

FIELD OF THE INVENTION

The present invention relates to storm shutters and, more particularly, to transparent storm shutters for protecting glass windows and doors.

BACKGROUND OF THE INVENTION

Violent storms are natural phenomena that often generate winds having the potential for destruction of property and life. This potential is evidenced upon review of the storm systems known as Hurricane Hugo and Hurricane Andrew that struck the eastern coast of the United States. Hurricane Andrew was especially destructive taxing the entire nation in the form of rebuilding costs and insurance rates. In light of the escalating costs for rebuilding, home owners, business owners and insurance companies alike have a common goal in protecting property. Proper shuttering of windows and doors, typically the weakest portion of a structure, has become a necessity if the structure's contents are to be protected.

The study of storms have determined that storm shutters must withstand more than just high winds. In reality the majority of the destruction is a direct result of impacts by debris carried by these high winds. In an effort to reduce the destructive effect of such windborne debris, changes to the building codes in areas frequently subjected to these type storm systems have been proposed, notably in South Florida. One change that appears imminent includes requiring that storm shutters withstand a large missile impact test. The SBCCI Standard for Windborne Debris Impact Tests (SSTD 11-93) is presently proposed for inclusion in the South Florida Building Code, namely the county of Dade and Broward. Testing is performed by projecting a large object, such as a length of 2×4 lumber, at a high velocity of 50 feet per second or higher, against the storm shutter being tested. This is intended to simulate the impact of windborne debris in a hurricane or similar storm. To successfully pass the test the portion of a structure to be protected, such as a glass window or door, must remain intact after the projectile has impacted the shutter.

Along with providing protection from such windborne debris, it has been found desirable for storm shutters to be constructed of translucent materials so as not to nullify the main purpose of transparent glass windows and doors. The transparent materials prevent claustrophobic tendencies of occupants secured within the structure yet permits law enforcement officials to inspect shuttered structures.

A number of U.S. Pat. Nos., notably numbers 4,685,261, 4,175,357, and 5,228,238, disclose various types of translucent storm shutter assemblies having a transparent panel constructed with flat plastic sheets such as polycarbonate and mounted in a frame of aluminum or steel. A problem with polycarbonate is its thermal coefficient of expansion which is significantly higher than aluminum or steel. The plastic sheet used in the '261 and '357 patents is firmly secured to a frame with little if any allowance for expansion and contraction relative to the frame. Such restriction can cause the shutter assembly to become damaged even without exposure to storms. The plastic sheet used in the '238 patent, on the other hand, is mounted to its frame so as to allow each sheet relative freedom to expand and contract. As taught by the '238 patent, this problem may be avoided by mounting each plastic sheet in a frame so that it is relatively unrestricted and free to change in size in response to temperature changes. In order to accomplish this, however, the '238 patent discloses a very elaborate and thus relatively expensive storm shutter assembly.

A common problem shared by transparent storm shutters of the prior art is that in order to successfully pass a missile impact test, like that previously described, each plastic sheet is relatively thick, typically on the order of 0.5 inches or more. Since impact resistant plastics such as polycarbonate are relatively expensive, the cost of manufacturing transparent storm shutters increases proportionately to the thickness of the material. Thicker plastic sheets also make each storm shutter heavier and more cumbersome to transport, store, install and remove. In addition, as the weight of the storm shutter increases, the anchoring mechanism used to secure the storm shutter to a structure must be able to bear the additional weight as well as withstand the storm.

Therefore, there is a need for a transparent storm shutter that is relatively inexpensive to manufacture, and is easy to install and remove, yet capable of withstanding direct impacts from windborne debris during a storm.

SUMMARY OF THE INVENTION

The present invention is directed to a relatively inexpensive transparent storm shutter assembly that is lightweight and of relatively simple construction, easy to install and remove, and capable of sufficiently resisting direct impacts from windborne debris during a storm.

The present storm shutter assembly is used to protect glass windows and doors in homes, office buildings and other walled structures from the destructive force of storm systems, such as hurricanes. The present storm shutter assembly includes a corrugated panel made up of at least one sheet and preferably a plurality of sheets of a shatter-resistant and transparent plastic material having a plurality of corrugations. Each sheet is firmly secured to the walled structure.

In one embodiment of the present storm shutter assembly, each corrugated sheet of the plastic material is fastened directly to the outside wall of a structure by any suitable bolt anchoring system. In other embodiments, as will be discussed in greater detail hereafter, the corrugated panel can be secured to the walled structure by use of brackets. For example, when a storm shutter is struck by windborne debris, the shutter panel will deflect toward the surface being protected, such as a glass window. Therefore, depending upon how deep the glass window is setback, it may be desirable to use one or more standoff brackets to ensure a minimum distance is maintained between the shutter panel and the glass.

In embodiments where a plurality of the corrugated plastic sheets are used to make one shutter panel, it has been found desirable to overlap the corrugations of adjoining sheets by half a corrugation or more in order to provide additional impact resistance against windborne debris. When using corrugated plastic sheets, rather than the flat sheets taught by the prior art, the present shutter panel may be secured in place with less chance of damage from thermal expansion and contraction. Further, because each corrugated sheet of plastic material may be firmly secured in place, the present storm shutters may be mounted to the walled structure with less elaborate, and thus less expensive, mounting systems than those used in prior transparent storm shutters.

It has also been found that as an additional benefit, the particular corrugated construction of the present shutter panel enables thinner sheets of the plastic material to be used while still providing the same degree of impact protection previously provide by thicker flat sheets of the same material.

Thus, it is an objective of the present invention to teach a translucent corrugated shutter panel using an overlap design that is resistant to windborne debris.

Another objective of the present invention is to teach a shutter panel that may be sufficiently secured in place to restrict the thermal expansion and contraction of the plastic sheets with less chance of damage.

Still another objective of the present invention is to teach a shutter panel having a particular corrugated construction which enables thinner sheets of the plastic material to be used while still providing the same degree of impact protection previously provided by thicker flat sheets of the same material.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
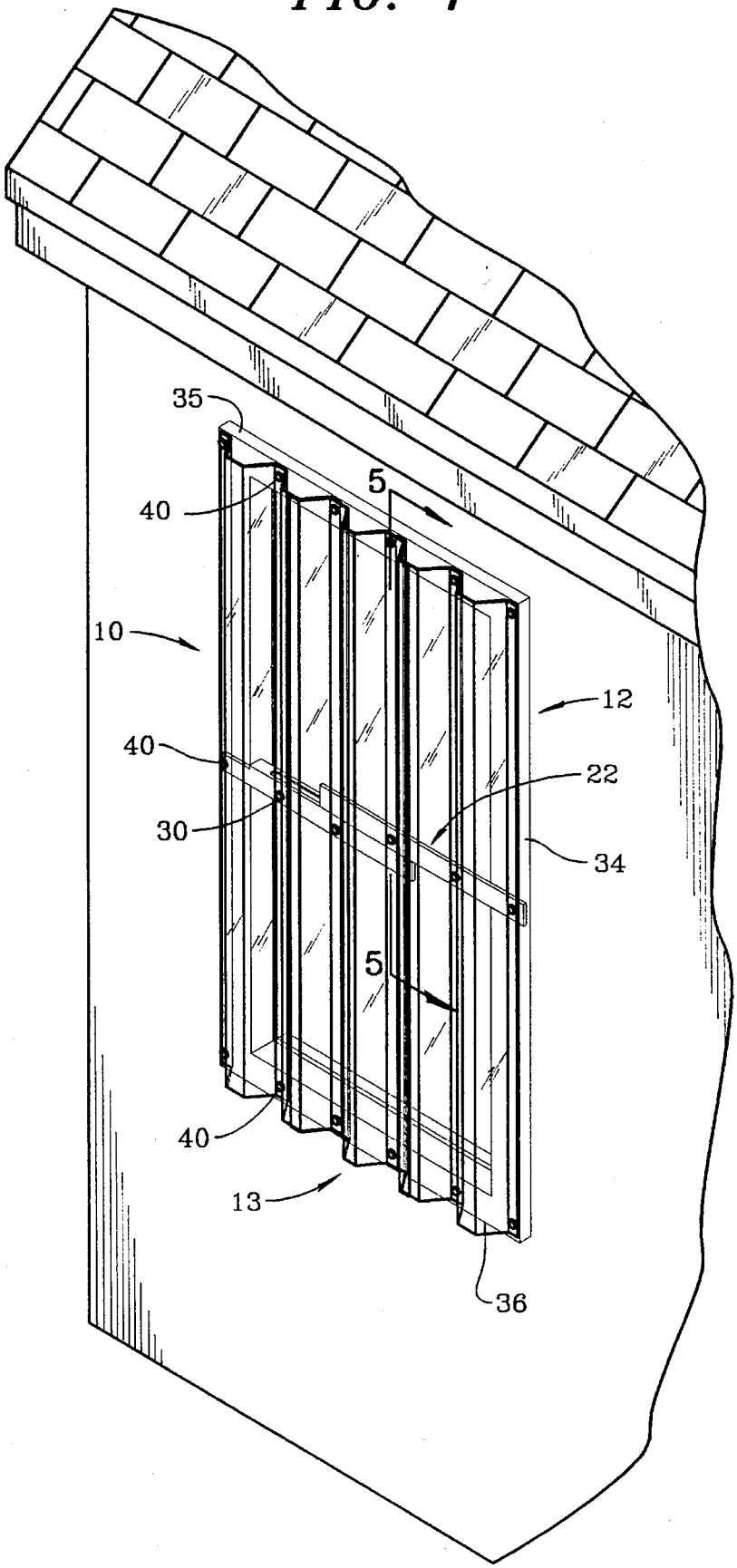
FIG. 1 is a perspective view of one embodiment of the present transient storm shutter assembly mounted over a glass window.
Figure 2:
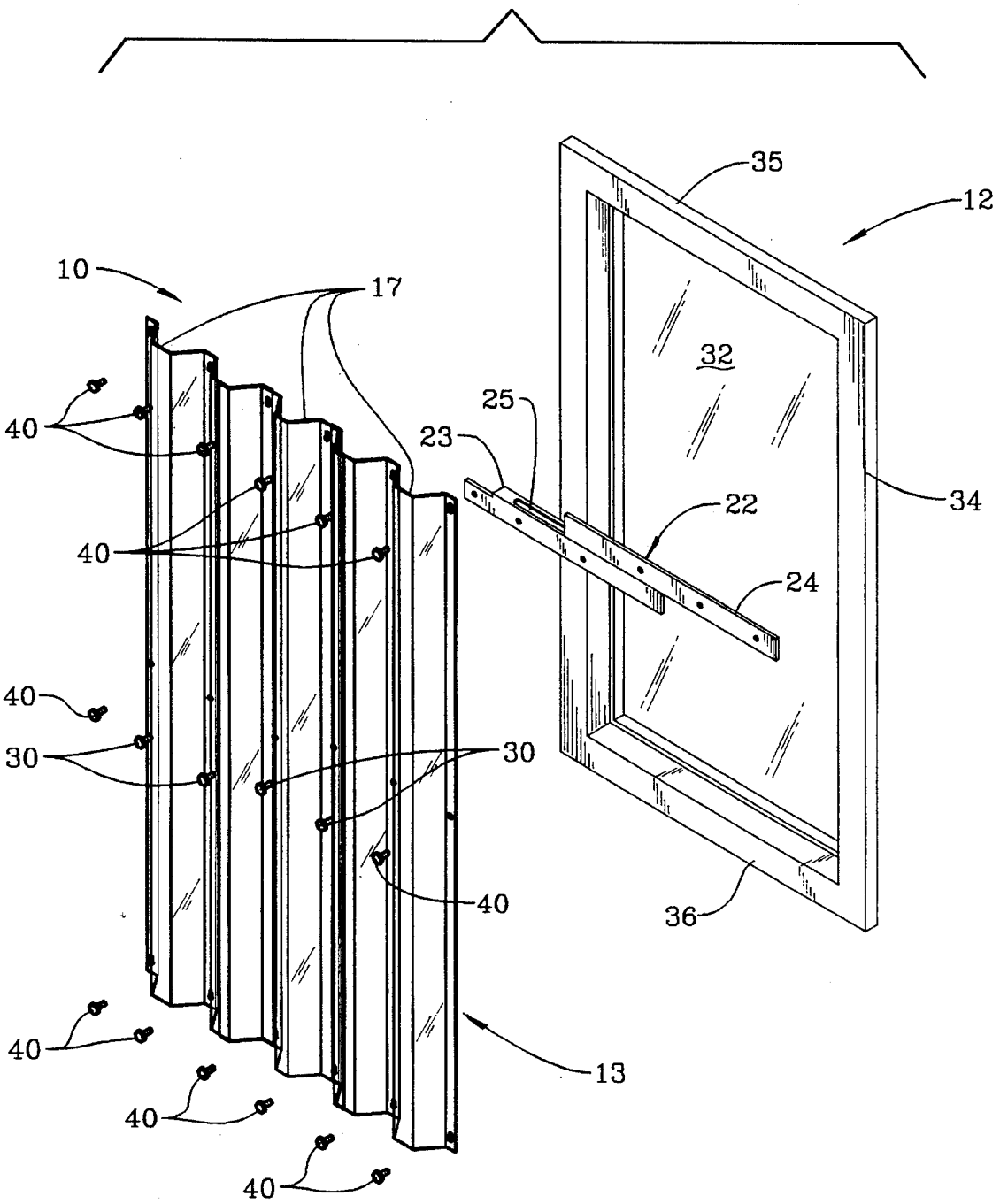
FIG. 2 is an exploded perspective view of the storm shutter assembly of FIG. 1.
Figure 3:
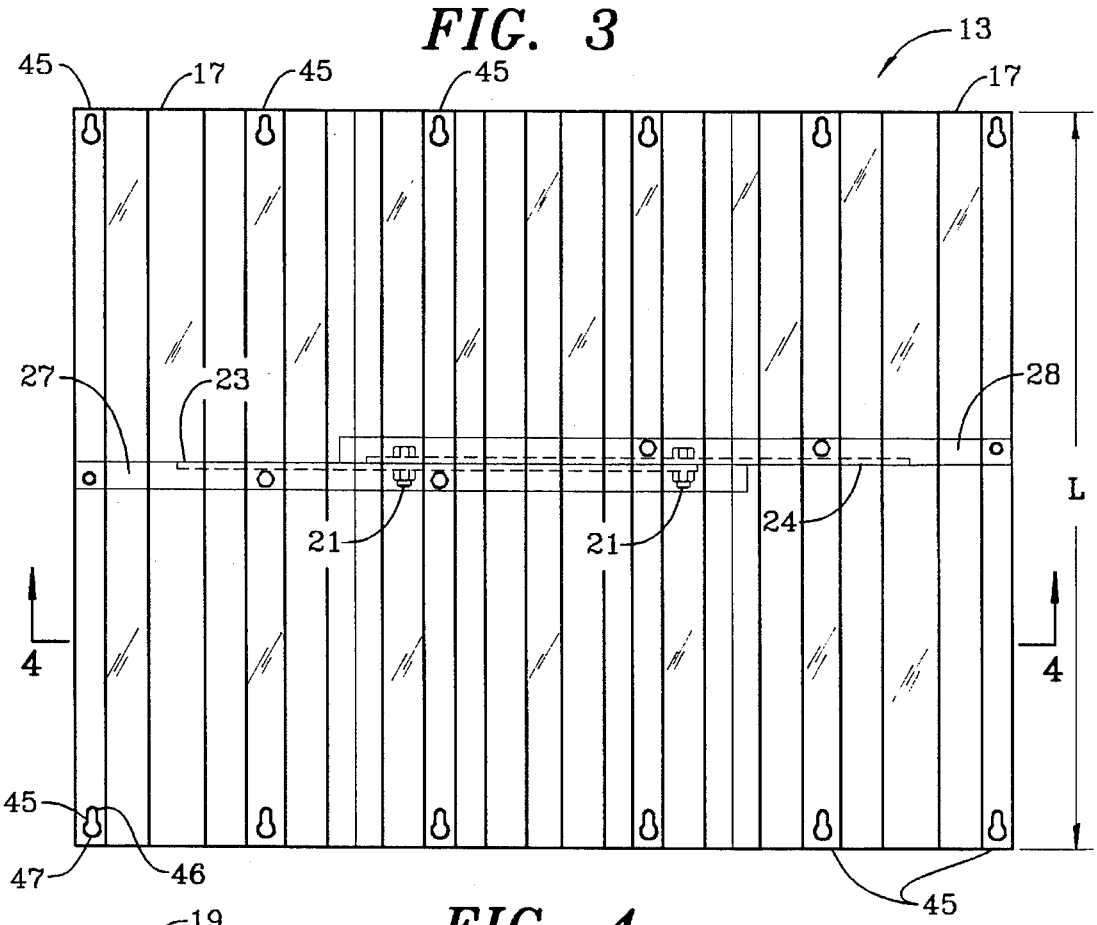
FIG. 3 is an elevational front view of the panel subassembly of the storm shutter assembly of FIG. 1.
Figure 4:
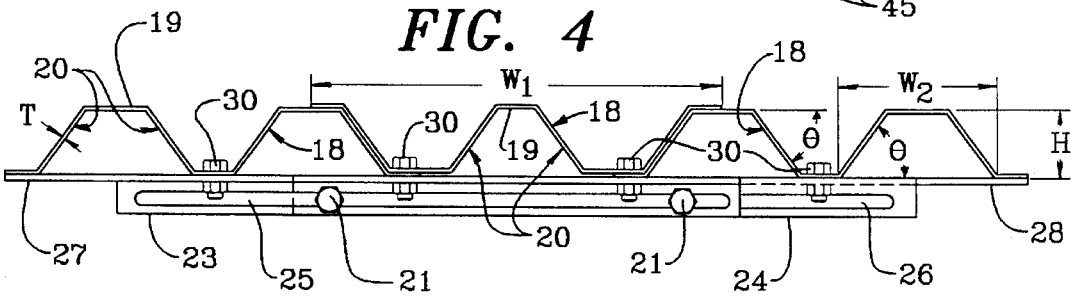
FIG. 4 is a bottom end view of the storm shutter panel of FIG. 3 taken along line 4—4.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

The present invention is directed to a transparent storm shutter assembly 10 for protecting a glass window 12 or door (not shown) from the high force winds and windborne debris typical of storm systems such as hurricanes.

Referring in general to FIGS. 1–5, one embodiment of the present storm shutter assembly 10 includes a corrugated panel 13 made up of a plurality of shatter-resistant and transparent plastic sheets 17. Each sheet 17 has a plurality of corrugations 18 running along its length L. The length L of each sheet 17 is two, three, or even more times as long as its width $W_1$. The preferred plastic material for making the sheets 17 is a UV stabilized clear polycarbonate plastic, such as the Makrolon 1143 polycarbonate material manufactured by Miles Laboratory. When such a material is used, satisfactory results have been obtained using sheets 17 having a wall thickness T of about 0.093 inches. However, it is believed that other wall thicknesses T may produce satisfactory results, and therefore the present invention is not intended to be so limited. For example, a wall thickness T of up to 0.062", up to 0.093", up to 0.125" or even more may also produce satisfactory results. Such corrugated sheets 17 may be produced using any suitable manufacturing technique. Actual sheets 17 have been manufactured using a vacuum thermo-forming process. In such a process, the plastic, which is purchased in the form of a flat sheet, is softened by being heated and then drawn down onto a mold by vacuum. The plastic sheet is allowed to cool, thereby producing the desired corrugated shape. It is believed that the present sheets 17 may also be extruded from a die also using well known techniques. Each corrugation 18 also has a width $W_2$ in the range of about 3.0 inches to about 6.0 inches and a height H in the range of about 1.5 inches to about 2.5 inches. Each corrugation 18 has a leading face 19 and two side faces 20. Each side face 20 extends back from its corresponding leading face 19 at an angle θ in the range of 45° to 85°, and preferably in the range of 50° to 60°. The leading face 19 has a width in the range of about 0.25 inches to about 2.5 inches. Preferably face 19 is closer to 2 inches wide to give the panel 13 more of a window quality. The distance between two adjacent corrugations 18 is typically less than the width of leading face 19, preferably about 1.0 inch. However, every other sheet 17 is reversed (see the middle sheet 17 in FIG. 4) to overlap the sheets by half a corrugation 18. These reversed sheets 17 thus have leading faces 19 that are narrower than those of the sheets 17 that are not reversed. Key-way type slots 45 are used to prevent the passage of the head of a fastener therethrough for firmly securing the corrugated panel to a walled structure. The key-way slot 45 has an enlarged portion 47 for insertion of the fastener head into the slot and an upper portion 46 adapted to receive the shank of a fastener. The slots 45 have a major axis running generally parallel to the corrugation.

Figure 6:
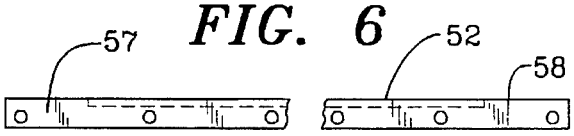
FIG. 6 is an elevational front view of an alternative single piece stiffening bar for use in the present storm shutter assembly.

Especially when the length L of each sheet 17 approaches or exceeds 3 times its width $W_1$, it may be desirable to fasten a stiffening cross bar 22 across each sheet 17 in order to provide additional rigidity to the panel 13. The cross bar 22 is preferably fastened to each sheet 17, such as with a plurality of bolt assemblies 30, in a direction generally transverse to the corrugations 18. The cross bar 22 may be of single piece construction, as shown in FIG. 6, but preferably is of two piece construction. Cross bar 22 has a left hand bar 23 and a right hand bar 24, each being a length of angled bar stock made of structural steel or any other material of sufficient stiffness. The bars 23 and 24 are bolted together with bolt assemblies 21 and slidable within corresponding slots 25 and 26 respectively formed therethrough. The overall length of the cross bar 22 may be changed by loosening the corresponding bolts 21, sliding the two bars 23 and 24 by each other until the desired length is obtained and then tightening the bolts 21, locking the bars 23 and 24 in place. Thus, cross bar 22 may be adjusted to fit within a variety of different size windows 12 or doors (not shown). Each bar 23 and 24 includes a respective flat section 27 and 28 which is preferably fastened to the window 12.

The window 12 has a glass plate 32 mounted in a frame 34 having a horizontal upper member or header 35 and lower member of sill 36. With such a window structure, the panel 13 is preferably mounted to the frame 34. While the panel 13 may be mounted with its corrugations .running horizontal (i.e., parallel to the upper and lower members 35 and 36), the panel 13 is preferably mounted with its corrugations 18 running vertically (i.e., perpendicular to the upper and lower members 25 and 26). The ends of panel 13 are mounted directly to respective members 35, 36 of the frame 34, such as with a plurality of bolt anchors 40. The flat sections 27 and 28 of bar 22 are also anchored into frame 34 with anchors 40, either before or after bar 22 and panel 13 are fastened together. It may also be desirable to indirectly secure the panel 13 to the frame 34 using intermediate brackets.

Figure 5:
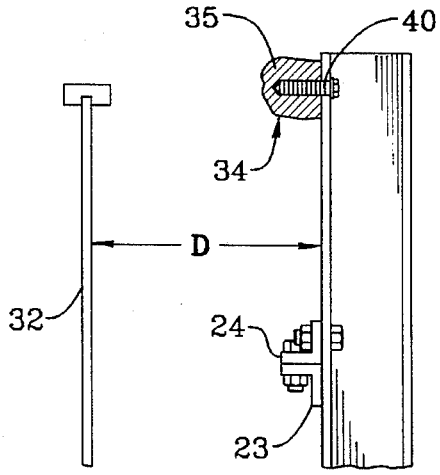
FIG. 5 is a partially sectioned side view of the installed storm shutter assembly of FIG. 1 taken along lines 5—5.
Figure 5A:
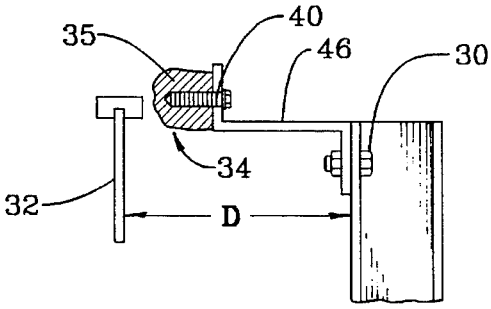
FIG. 5A is a partially sectioned side view similar to that of FIG. 5 but showing an alternative panel mounting system.

Referring to FIG. 5A, when the storm shutter 10 is struck by windborne debris during a storm, the shutter panel 13 will deflect toward the glass plate 32. Therefore, the panel 13 is mounted a sufficient distance D from glass 32 to ensure that panel 13 will not be deflected back into and damage the glass 32. Depending upon how deep the glass plate 32 is set back, it may be desirable to mount one or more standoff brackets 46 between the window frame 34 and each sheet 17 of panel 13 in order to ensure the appropriate distance D exists. Each bracket 46 may be fastened to the sheets 17 with bolt assemblies 30 and anchored to the frame 34 with anchors 40.

Referring to FIG. 6, instead of the two piece cross bar 22, a single piece cross bar 52 may be used. Cross bar 52 may be made of a length of the same angled stock material as bars 23 and 24 but with a flat section 57 and 58 at either end.

A prototype of storm shutter 10 has successfully passed a large missile impact test performed according to the SBCCI Standard for Windborne Debris Impact Test (SSTD 11-93). The exemplary storm shutter 10 had a panel 13 of 4.5 corrugated sheets 17 which were overlapped in the manner shown in FIG. 4 and previously described. Each exemplary sheet 17 was made of the previously described polycarbonate material with a length L of 91.5", a width $W_2$ of 13.5" and a wall thickness of 0.093". Each corrugation 18 had a height H of about 2.25" and a typical width $W_2$ of 5.0". Any two adjacent corrugations on each sheet 17 were separated by a flat strip having a typical width of 1.0" or for those sheets which were reversed to facilitate overlapping (see the middle sheet 17 in FIG. 4), a typical width of 2.0". Similarly, the leading face 19 of each corrugation 18 was either 2.0" wide or for the reversed sheets 17 1.0" wide. In either case, the side faces 20 of each corrugation 18 slanted back from their corresponding leading face 19 at a typical angle θ of about 55°. The above described exemplary panel 13 was fastened to a frame similar to frame 34 using a plurality of 0.25" machine screws with washer faced wing nuts (not shown). One machine screw was used on either side of each corrugation 18 at either end of the panel 13, as shown in FIG. 1. In addition, one such machine screw was used approximately every 15" to anchor either side of the exemplary panel 13 to the sides of the test frame (not shown). Instead of one cross bar 22, two cross bars 22 equally spaced vertically were used. The exemplary storm shutter assembly successfully withstood the impact of a 97" length of 2×4 lumber weighing nine pounds, two ounces and travelling at a speed of 50.5 feet/second. Storm shutters using flat sheets of polycarbonate material were also subjected to the above described test. However, in order to successfully pass the impact test, these storms shutters had to use sheets with thicknesses on the order of 0.5" or more.

Because the present storm shutter assembly uses corrugated rather than flat sheets of the shatter resistant transparent plastic material, its shutter panel may be firmly secured in place and thermal expansion and contraction of each sheet 17 restricted without the risk of the damage taught by the prior art. Thus, the present shutter panel 13 may be mounted with less elaborate and less expensive mounting mechanisms then those previously used for transparent storm shutters. The corrugated construction of the present shutter panel 13 has the added benefit of enabling thinner sheets of the plastic material to be used while still providing the same degree of impact resistance afforded by much thicker flat sheets of the same plastic material.

From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

What is claimed is:

1. A storm shutter kit for protecting a glass window or door in a walled structure, comprising:

a corrugated panel consisting of a plurality of sheets constructed from a shatter-resistant and transparent plastic material, each said sheet having a plurality of corrugations overlapping at least a portion of another sheet adjacent thereto being inverted relative to any sheet it overlaps, each said sheet having at least one key-way slot with a major axis running generally parallel to the corrugations adapted to receive the shank of one fastener therethrough;

a plurality of fasteners, each fastener having a shank and an enlarged head to prevent the passage of the head through said slot; and a mounting mechanism for firmly securing the corrugated panel to the walled structure.

2. The storm shutter kit of claim 1, said mounting mechanism including a stand-off bracket for separating said corrugated panel from the glass window or door.

3. The storm shutter kit of claim 1, including a stiffening bar mounted to said corrugated panel generally across the plurality of corrugations.

4. The storm shutter kit of claim 1, each said sheet having a wall thickness of up to about 0.125 inches.

5. The storm shutter kit of claim 1, each said sheet having a wall thickness of up to about 0.093 inches.

6. The storm shutter kit of claim 1, each said sheet having a wall thickness of up to about 0.062 inches.

7. The storm shutter kit of claim 1, each of said plurality of corrugations having a height in the range of about 1.5 inches to about 2.5 inches.

8. The storm shutter kit of claim 1, each of said plurality of corrugations having a width in the range of about 3.0 inches to about 6.0 inches.

9. The storm shutter kit of claim 1, each of said plurality of corrugations having a leading face and two side faces, each side face extending back from said leading face at an angle in the range of about 45° to about 85°.

10. The storm shutter kit of claim 9, each side face extending back from said leading face at an angle in the range of about 50° to about 60°.

11. The storm shutter of claim 9, the leading face of each of said plurality of corrugations having a width in the range of about 0.25 inches to about 2.5 inches.

12. The storm shutter kit of claim 1, said sheets having a length and a width, the length being at least twice as long as the width.

13. The storm shutter kit of claim 1, said sheet having a length and a width, the length being at least 3 times as long as the width.

14. A storm shutter kit for protecting a glass window or door in a walled structure, comprising: a corrugated panel consisting of a plurality of sheets constructed from shatter-resistant transparent plastic material having a length and a width, the length being at least twice as long as the width and a nominal thickness with said corrugations having a leading face and two side faces, each side face extending back from said leading face at an angle in the range of about 45 degrees to about 85 degrees, each said sheet having a plurality of corrugations overlapping at least a portion of another sheet adjacent thereto being inverted relative to any sheet it overlaps, each said sheet having at least one key-way slot with a major axis running generally parallel to the corrugations adapted to receive the shank of one fastener therethrough; a plurality of fasteners, each fastener having a shank and an enlarged head to prevent the passage of the head through said slot; and a stand-off bracket for firmly securing the corrugated panel to the walled structure.

* * * * *